US006827527B2

(12) United States Patent
Conkel et al.

(10) Patent No.: US 6,827,527 B2
(45) Date of Patent: Dec. 7, 2004

(54) WALL COMPONENTS AND METHOD

(75) Inventors: James E. Conkel, Lawrenceville, GA (US); Richard J. Valentine, Alpharetta, GA (US)

(73) Assignee: The New Castle Group, Inc., Lawrenceville, GA (US)

( * ) Notice: Subject to any disclaimer, the term of this patent is extended or adjusted under 35 U.S.C. 154(b) by 0 days.

(21) Appl. No.: 10/439,434

(22) Filed: May 16, 2003

(65) Prior Publication Data

US 2004/0022587 A1 Feb. 5, 2004

Related U.S. Application Data

(63) Continuation of application No. 09/467,271, filed on Dec. 20, 1999, now abandoned.

(51) Int. Cl.[7] ..... E02D 29/02

(52) U.S. Cl. ..... 405/284; 405/262; 405/286; 52/605

(58) Field of Search ..... 405/262, 284, 405/286; 52/605, 606

(56) References Cited

U.S. PATENT DOCUMENTS

| | | | | |
|---|---|---|---|---|
| 4,324,508 A | | 4/1982 | Hilfiker et al. | |
| 4,512,685 A | | 4/1985 | Hegle | |
| 4,616,959 A | | 10/1986 | Hilfiker | |
| 4,661,023 A | | 4/1987 | Hilfiker | |
| 5,017,049 A | | 5/1991 | Sievert | |
| 5,044,834 A | | 9/1991 | Janopaul, Jr. | |
| 5,064,313 A | | 11/1991 | Risi et al. | |
| 5,145,288 A | | 9/1992 | Borcherdt | |
| 5,161,918 A | | 11/1992 | Hodel | |
| 5,214,898 A | | 6/1993 | Beretta | |
| 5,257,880 A | | 11/1993 | Janopaul, Jr. | |
| 5,417,523 A | | 5/1995 | Scales | |
| 5,419,092 A | | 5/1995 | Jaecklin | |
| 5,484,235 A | | 1/1996 | Hilfiker et al. | |
| 5,511,910 A | | 4/1996 | Scales | |
| 5,540,525 A | | 7/1996 | Miller et al. | |
| 5,595,460 A | | 1/1997 | Miller et al. | |
| 5,607,262 A | | 3/1997 | Martin | |
| 5,816,749 A | | 10/1998 | Bailey, II | |
| 6,224,295 B1 | * | 5/2001 | Price et al. | 405/262 |
| 6,318,934 B1 | * | 11/2001 | Borgersen et al. | 405/262 |
| 6,322,291 B1 | * | 11/2001 | Rainey | 405/262 |
| 6,416,257 B1 | * | 7/2002 | Rainey | 405/262 |
| 6,443,662 B1 | * | 9/2002 | Scales et al. | 405/262 |
| 6,490,837 B1 | * | 12/2002 | Dueck et al. | 52/592.6 |
| 6,536,994 B2 | * | 3/2003 | Race | 405/262 |
| 6,612,784 B2 | * | 9/2003 | Rainey et al. | 405/284 |
| 6,679,656 B1 | * | 1/2004 | Manthei | 405/284 |

FOREIGN PATENT DOCUMENTS

| | | | |
|---|---|---|---|
| WO | WO 9806907 A1 * | 2/1998 | E02D/29/02 |

* cited by examiner

*Primary Examiner*—Robert E. Pezzuto
*Assistant Examiner*—Alexandra K. Pechhold
(74) *Attorney, Agent, or Firm*—Kilpatrick Stockton LLP

(57) ABSTRACT

The present invention provides a wall that is easy to construct and is able to utilize the long-term design strength of a geosynthetic reinforcement connection or anchor. In accordance with one or more of the embodiments, the wall comprises a multifaceted rotatable locking bar in contact with one end of a geosynthetic reinforcement; a lower block with an edgeless surface section adjacent a receiving channel which accepts the locking bar and geosynthetic reinforcement; and, an upper block with a receiving channel which also accepts the locking bar and geosynthetic reinforcement. A force applied to an opposite end of the geosynthetic reinforcement is transferred, via the geosynthetic reinforcement, to the locking bar causing the bar to rotate and engage the geosynthetic reinforcement with at least one side of a receiving channel. In this manner, the reinforcement is engaged with the stacked blocks and the stacked blocks are united with the adjacent support or backfill.

21 Claims, 5 Drawing Sheets

WALL COMPONENTS AND METHOD

RELATED APPLICATIONS

The present invention is a continuation of U.S. patent application Ser. No. 09/467,271, filed Dec. 20, 1999 now abandoned.

TECHNICAL FIELD

The present invention, as illustrated by its many embodiments, relates primarily to a geosynthetic-reinforced segmental retaining wall (SRW). The components of a wall illustrated herein include a geosynthetic reinforcement loaded at one end and in contact with a locking bar at an opposite end. The locking bar and a section of the geosynthetic reinforcement are then captured between lower and upper segmental units. Such a wall is able to realize the long-term design strength of the geosynthetic reinforcement because the locking bar rotates to engage and hold the entire width of the geosynthetic reinforcement to an interior surface of the segmental units which comprise the wall.

BACKGROUND OF THE INVENTION

The building construction and land development industry requires retaining walls to stabilize substantially vertical sections of earth. Retaining walls can be constructed on-site with poured-in-place concrete or assembled on-site with various segmental units. One type of assembled wall is constructed with pre-manufactured blocks stacked to form an exposed wall face. In practice, a connector is typically located between vertical courses of stacked block and is integral with a solid anchor embedded in the backfill—the tamped earth immediately adjacent to the stacked blocks. The anchor and connector effectively unify the backfill and stacked blocks to create the retaining wall. U.S. Pat. No. 5,921,715 is representative of traditional anchors and connectors.

Recently, improved reinforced-earth systems have emerged as low cost alternatives to the above wall assemblies. In these improved systems the soil is reinforced with geosynthetics; materials made typically from high-tenacity polyester, polypropylene, and high-density polyethylene. Polyester and polypropylene geosynthetics are usually woven into a relatively flexible and dimensionally stable grid or textile matrix. They are referred to as "geogrids" and "geotextiles", respectively. Polypropylene and high-density polyethylene are also used to manufacture relatively stiff geogrids using an extrusion-based process. As will be understood by those skilled in the art, geosynthetic reinforcements may be "stiff" or may be "flexible."

The designer of a geosynthetic-reinforced earth retaining wall must consider the strength of the connection—the point at which forces exerted on the segmental unit are transferred to the geosynthetic reinforcement. An objective of the designer is to minimize the relative displacement between the geosynthetic reinforcement and the segmental units. By minimizing the relative displacement, the possibility of bulging, leaning, and other types of undesirable wall movement is reduced. The relative displacement can be reduced by a connection between the unit and reinforcement. Forces which tend to create the displacement include those exerted by soil at the back of the units and those which develop in the plane of the geosynthetic reinforcement. If the forces at the back of the unit can be transferred to the geosynthetic via a connection, the total relative displacement between the unit and geosynthetic can be significantly reduced.

Therefore, the strength of the connection between the unit and geosynthetic govern the magnitude of the reduction in relative displacement. Using prevalent standard practice, the relative displacement is reduced to acceptable levels when the peak strength at the connection of the geosynthetic reinforcement and segmental retaining wall unit exceeds the horizontal stress applied to the back of the segmental unit.

If it is not possible with a given type of unit and geosynthetic to develop a connection strength which exceeds the horizontal stress, then the magnitude of the horizontal stress must be reduced. This reduction can be accomplished by decreasing the vertical space between layers of geosynthetic reinforcement. However, a decrease in distance between layers of reinforcement equates to more layers of reinforcement, and results in higher reinforcement costs.

Another objective of the designer is to limit tensile stresses in the plane of the geosynthetic reinforcement to levels below the material's long-term design strength (LTDS). The magnitude of these stresses are a function of geosynthetic reinforcement spacing, soil strength, wall height, and load conditions at the top of the wall. A reinforcement design which is optimal with respect to geosynthetic costs is one in which the LTDS of the geosynthetic exceeds the calculated stresses in the geosynthetic by an amount deemed to provide an adequate factor to safety against tensile rupture.

Thus, the design of the geosynthetic reinforcement for a segmental retaining wall system is primarily controlled by two factors: 1) the peak connection strength between the segmental units and the geosynthetic reinforcement; and 2) the LTDS of the geosynthetic reinforcement. If the peak connection strength is less than the LTDS of the geosynthetic, the connection strength is said to control the reinforcement design. If the peak connection strength is greater than the LTDS of the geosynthetic, the geosynthetic strength is said to control the reinforcement design.

For most combinations of segmental retaining wall units and geosynthetic reinforcement available in today's market, peak connection strength controls the reinforcement design for wall heights in excess of 10 to 15 feet. This limitation exists because the walls rely on one of two mechanisms, or a combination of both, to connect geosynthetic reinforcement to segmental units: 1) friction between the reinforcement and the segmental units; and 2) a dowel which is inserted into the lower and upper segmental units.

For frictional systems, the strength of the connection depends on the coefficient of friction between the geosynthetic and the segmental unit and the normal load applied at the frictional interface. At low to medium normal loads, failure of the connection usually occurs because the reinforcement slips between the segmental units. At high loads, the geosynthetic is often damaged and weakened as slips between the segmental units, and it may fail and rupture.

For dowel-based systems, the dowel passes through an aperture in geogrid reinforcement or between yarns in a geotextile reinforcement. Connection failure of flexible geogrids in dowel systems typically occurs when traverse geogrid members displace or rupture as they pull against the dowel. Similarly, connection failure of geotextiles in dowel systems typically occurs when yarns tear or displace as they pull against the dowel.

To compensate for the relatively inefficient connection of most geosynthetic reinforcement-segmental unit combinations, relatively frequent spacing of geosynthetic reinforcement is required. Because a relatively large amount of geosynthetic material is involved, these combinations can be inefficient with respect to cost. An optimized design is one in which the peak connection strength exceeds the LTDS required of the geosynthetic reinforcement.

It is known to provide a reinforced-earth retaining wall assembled from stacked blocks, which includes a connector bar positioned between vertical courses of block. The connector bar comprises a base and a series of spaced keys that project vertically. The connector bar is positioned in a channel of a lower block, and a geogrid is laid over the bar so as to hook a transverse member around each key. The geogrid is then extended laterally from the connector into the adjacent backfill. An upper block is then stacked over the connector bar to complete the connector assembly.

It is also known to construct a reinforced-earth retaining wall by providing a geosynthetic reinforcement wrapped around a solid body anchor located within a segmental unit. For example, a trough receives an anchor wrapped in a geotextile wherein the trough is then loaded with backfill. Alternatively, the trough may receive an anchor wrapped in a geotextile wherein the anchor is then mechanically fastened to the trough before the trough is loaded with backfill.

Another reinforced-earth retaining wall provides a flexible polymer sheet anchor that is connected to an assembly of stacked blocks by wedging one end of the sheet into a slot located within the blocks. In this example, the sheet is laid in the slot followed by a wedging element that is hammered into the slot. The wedging element forces and holds the sheet against the bottom and walls of the slot.

The primary thrust of the prior art reinforced-earth components and methods is to construct a retaining wall using oversized stackable modules or specially manufactured components. In the former case, wall construction requires operator driven machinery capable of lifting heavy weights. In the latter case, wall construction requires labor intensive assembly of many small components. Further, by connecting to individual transverse members of the geosynthetic reinforcement, the prior art walls are unable to utilize the long-term design strength of the geosynthetic reinforcement. Also, the prior art components and methods require the anchor and wall connection be tightly fitted and locked during assembly. For example, a flexible sheet is hammered into a slot or a transverse member is hooked to a dowel. Finally, prior art components, specifically the segmental units, include edges and projections which often function to tear or rupture the geosynthetic reinforcement.

When geosynthetic reinforced segmental retaining walls are constructed, soil is compacted behind the segmental units on top of layers of geosynthetic reinforcement in "lifts" of 6 to 12 inches. Builders typically attempt to make the top of a soil lift level with the top of an adjacent segmental unit before installing a layer of geosynthetic reinforcement. However, this condition is very difficult to obtain. Usually, the elevation at the top of the soil lift is below the top of the adjacent segmental unit. When a layer of geosynthetic reinforcement is installed on the segmental unit and extended into the soil zone, it contours to the top of the unit and top of the soil lift, bending around the top rear corner of the segmental unit. As the wall height increases, soil adjacent to the back of the segmental units tends to settle slightly. The settlement applies tension to the portion of the geosynthetic in contact with the top rear corner of the segmental unit.

Currently, many types of segmental retaining wall units have a geometry such that the plane at the top and rear of the unit intersect at an angle of 90 degrees. In walls constructed with these units, the geosynthetic reinforcement extends from between the stacked units, turns downward at the back of the unit, and then extends into the reinforced soil zone. Where the geosynthetic turns around the top rear corner of the block, a concentration of shear stresses develop in the geosynthetic. Existing design and testing methodologies do not consider the development of these stresses, yet they are present in virtually all geosynthetic-reinforced segmental retaining wall structures. The development of the stresses may cause rupture in the geosynthetic reinforcement.

Thus, there exists a need for a reinforced-earth retaining wall which is constructed of hand-stackable modules; which is constructed from a minimum number of readily available components; which includes a connector that utilizes the long-term design strength of the geosynthetic reinforcement; which evenly distributes the load of the backfill across the width of the wall; which eliminates concentrated stresses within the components; which does not require the anchor and wall connection be tightly fitted and locked during assembly, and which provides components which do not pose a threat of rupture to the geosynthetic reinforcement.

SUMMARY OF THE INVENTION

The present invention, in one or more of its illustrated embodiments, seeks to cure the problems and prior art inadequacies noted above by providing a reinforced-earth retaining wall that is easy to construct and is able to utilize the long-term design strength of the geosynthetic reinforcement anchor.

In accordance with the present invention, this objective is accomplished by providing the components and a method of constructing a reinforced-earth retaining wall, comprising: a multifaceted rotatable locking bar in contact with one end of a geosynthetic reinforcement; a lower block with an edgeless surface section adjacent to a receiving channel which accepts the locking bar and geosynthetic reinforcement; and, an upper block with a receiving channel which also accepts the locking bar and geosynthetic reinforcement. With a load applied to an opposite end of the geosynthetic reinforcement, the forces exerted by the load are transferred via the geosynthetic reinforcement to the locking bar, causing the bar to rotate and engage the geosynthetic reinforcement with at least one side of a receiving channel.

Generally described, the present invention comprises a lower block, an upper block, a rotatable locking bar positioned between the blocks, and a geosynthetic reinforcement in contact with the locking bar. The lower block includes at least an upper receiving channel and an edgeless top surface. From the rear of the lower block to the upper receiving channel, inclusive, the top surface does not include an identifiable edge that could threaten or rupture the geosynthetic reinforcement. The upper block may include a lower receiving channel, but it is not required. When stacked, the lower and upper receiving blocks form a receiving conduit.

In practice, a lower block is set and a geosynthetic reinforcement is laid over the top surface and upper receiving channel. Thereafter, the locking bar is positioned within the receiving channel, over the geosynthetic reinforcement. The geosynthetic reinforcement is then looped back over to rest on top of the locking bar. Next, the upper tier block is placed over the lower block to form a receiving conduit which fully encapsulates the locking bar and a section of the geosynthetic reinforcement.

In one embodiment, the receiving conduit is wider than the combination of the locking bar and wrapped geosynthetic reinforcement.

In another embodiment, the geosynthetic reinforcement is laid over the upper surface and upper receiving channel. The locking bar is then positioned within the upper receiving channel but the geosynthetic reinforcement is not wrapped back over the locking bar. Rather, it is permitted to extend past the receiving channel a short distance. Next, the upper tier block is placed over the lower block to form a receiving conduit which fully encapsulates the locking bar and a section of the geosynthetic reinforcement.

The geosynthetic reinforcement is extended behind the wall face into the adjacent soil mass and tensioned. As the wall height is increased, additional tension develops in the geosynthetic reinforcement. Also, horizontal earth stresses develop at the back of the segmental retaining wall units. Tension in the geosynthetic and pressure at the back of the segmental unit produces a relative displacement between these components. The displacement results in rotation of the locking bar in the receiving conduit. There, it binds the geosynthetic between the bar and the conduit walls. Once bound, stresses at the back of the segmental unit are transferred to the geosynthetic reinforcement and subsequent relative displacement between the unit and geosynthetic is eliminated or reduced to insignificant levels.

As the geosynthetic exits the receiving conduit, it presses against the edgeless surface section adjacent to the conduit. Because the surface is edgeless, no concentrated shear stresses are applied to the geosynthetic.

In practice, the combination of a geosynthetic reinforcement and rotatable locking bar filly utilizes the LTDS of the geosynthetic reinforcement because the locking bar is in full contact with the entire width of the geosynthetic reinforcement along all points. The full LTDS of the geosynthetic can be used because the peak connection strength exceeds the LTDS. The connection strength increases as the tensile stress in the reinforcement increases—that is, the higher the stress, the more force with which the rotating bar binds the geosynthetic.

The geosynthetic does not pass over an edge adjacent to the receiving conduit or at the back of the segmental unit where high shear stress would develop and cause premature rupture. Because of these features, optimized reinforcement design with respect to geosynthetic cost is possible.

DETAILED DESCRIPTION

Figure 1:
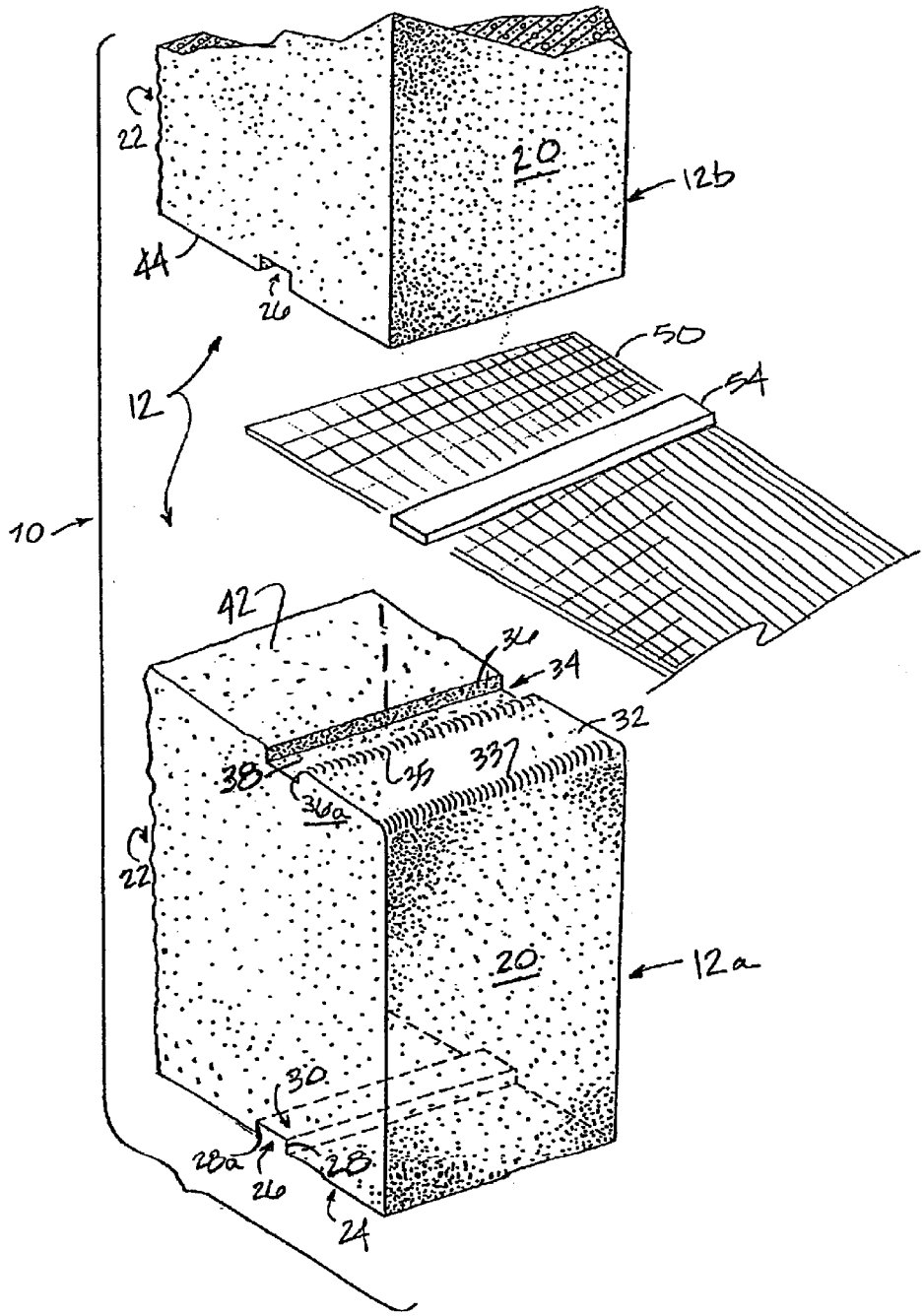
FIG. 1 is an exploded perspective view of an embodiment of the present invention.
Figure 4:
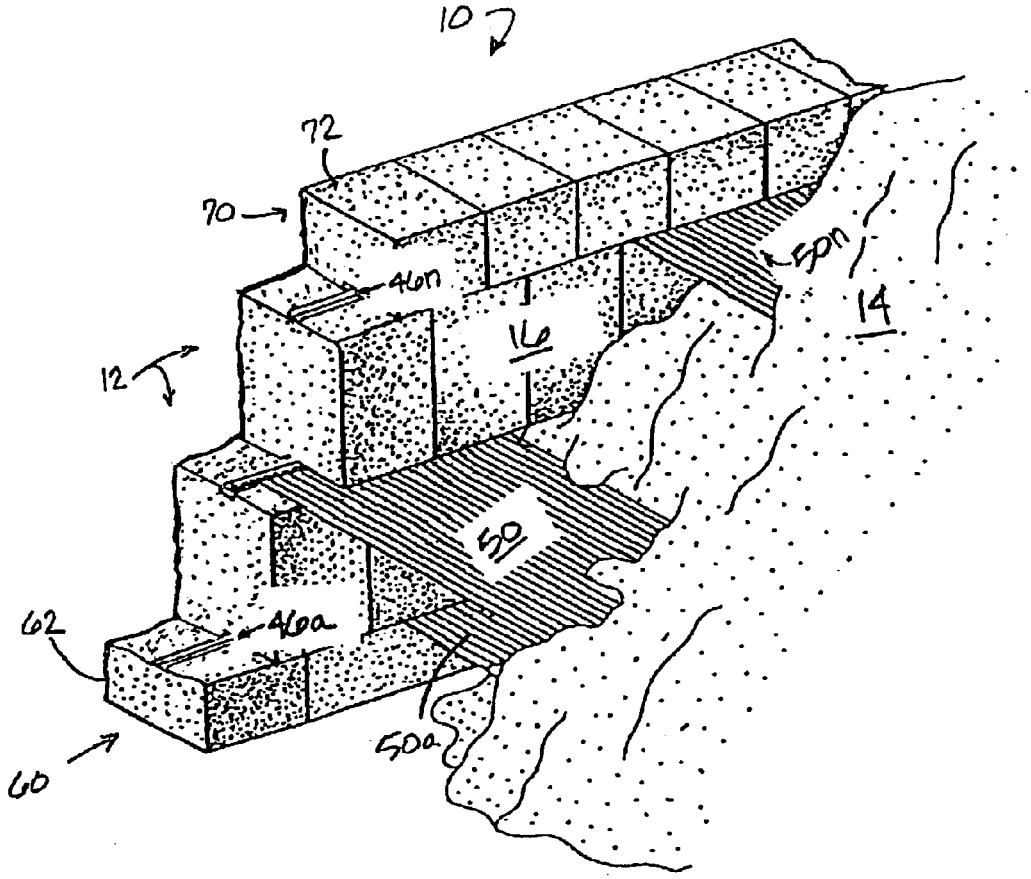
FIG. 4 is a perspective view of a reinforced-earth wall constructed using an embodiment of the present invention.

Referring now in more detail to the drawings, wherein like numerals refer to like parts throughout the several views, FIG. 1 is an exploded perspective view of a portion of a retaining wall 10 according to an embodiment of the present invention. The wall 10 comprises at least a lower block 12*a* and an upper block 12*b* in a stack. As best illustrated in FIG. 4, the blocks 12 are both stacked and placed side-by-side to form an elongated retaining wall 10 having dirt, rocks or other backfill material 14 on an interior side 16 of the wall. As understood by those skilled in the art, the backfill material may include any mass including poured concrete.

Returning to FIG. 1, each block 12 has an interior face 20 and exposed exterior face 22. The exposed face 22 is that section visible when the wall is complete, and may include an ornamental finish (not shown). Each block 12 includes a bottom surface 24 with a lower channel 26 extending the width of the block 12. The lower channel 26 is defined by a pair of side walls 28 and a top 30.

Each block 12 includes a top surface 32 with an upper channel 34 extending the width of the block 12. The upper channel 34 is defined by side walls 36 and a bottom 38. The top surface 32 is edgeless from the upper channel 34 to the interior face of the block 20. In other words, the intersection of the interior face of the block 20 and the top surface 32 is edgeless and does not define a discernable edge but rather these two planes merge and blend with each other forming a radius 33. Similarly, the intersection of the edgeless top surface 32 with a first side wall 36*a* does not define a discernable edge but rather these two planes merge and blend with each other forming a radius 35.

In a preferred embodiment, the lower channel 26 and the upper channel 34 are transversely aligned.

An embodiment not shown includes a lateral alignment slot which parallels the upper channel 34 and receives an elongated rod during installation. This alignment slot and rod are best illustrated in U.S. Pat. No. 5,511,910, incorporated herein by reference, to which the applicant is the exclusive licensee.

Preferably, the blocks 12 are formed of precast concrete. However, other materials such as but not limited to stone, light-weight cementitious compounds, rigid foam, and extruded polymers, or a combination of any of the above, with or without reinforcements, is envisioned. An embodiment (not shown) defines a horizontally disposed interior opening which reduces material costs and weight without sacrificing performance characteristics of the block. Another embodiment (not shown) defines a vertically disposed interior opening for receiving aggregate or bonding material during construction of the wall. Another embodiment (not shown) includes interior passages of differing orientations that form raceways for such purposes as internal wiring, piping and ducts. Additional embodiments (not shown) include blocks having only an upper channel and blocks including only a lower channel. The embodiment comprising only a lower channel includes an edgeless bottom surface 24 substantially identical to the edgeless top surface 34 described above.

The illustrated embodiment of block 12 includes a top portion 42 between the exterior face 22 and the upper channel 34. A bottom portion 44, which mirrors the top portion 42, is formed on the opposite end between the exterior face 22 and a first side-wall 28*a*. When stacked, the bottom portion 44 of the upper block 12*b* rests on the top portion 42 of the lower block 12*a*. Another embodiment (not shown) includes top and bottom portions of varying configurations which interlock or matingly rest when stacked. When two blocks 12 are thus stacked together, the upper channel 34, of the lower block 12*a*, cooperates with the lower channel 26, of the upper block 12*b*, to define a receiving conduit 46, best shown in FIGS. 5*a* and 5*b*.

Another embodiment (not shown) includes only one receiving channel 34 within the top portion 42 and no receiving channel 26 in the bottom portion 44. Thus, the receiving conduit 46 is formed by the receiving channel 34 which is capped by the bottom portion 44. Another embodiment (not shown) includes only one receiving channel 26 within the bottom portion 44 and no receiving channel 34 in the top portion 42. Thus, the receiving conduit 46 is formed by the receiving channel 26 which is capped by the top portion 42.

Returning to FIG. 1, the embodiment illustrated includes a geosynthetic reinforcement 50 between blocks 12*a*, 12*b*. The geosynthetic reinforcement 50 may be a geogrid or a geotextile as is well known to those skilled in the art. However, any material of suitable tensile strength and flexibility will be considered an acceptable reinforcement. Thus, for the purpose of this disclosure, the term geosynthetic reinforcement is not limited to either a geogrid or a geotextile.

The geosynthetic reinforcement 50 functions as an anchor to tie the stacked blocks 12, 10 to the backfill material 14. In a preferred embodiment, the geosynthetic reinforcement 50 may be attached to stacked blocks 12*a*, 12*b* in either of two manners. Either one end of the geosynthetic reinforcement 50 is laid to rest over the top surface 32 and into the upper channel 34. Thereafter, a multifaceted locking bar 54 is inserted into the upper channel 34 and over the geosynthetic reinforcement 50. Next, the upper block 12*b* is stacked immediately upon the geosynthetic reinforcement 50 and multifaceted locking bar 54. Alternatively, the geosynthetic reinforcement 50 may be lapped back over the multifaceted locking bar 54 and then the upper block 12*b* stacked thereon. Each of these means to connect the geosynthetic reinforcement 50 and multifaceted locking bar 54 to the stacked blocks 12 is described in more detail below.

Figure 5A:
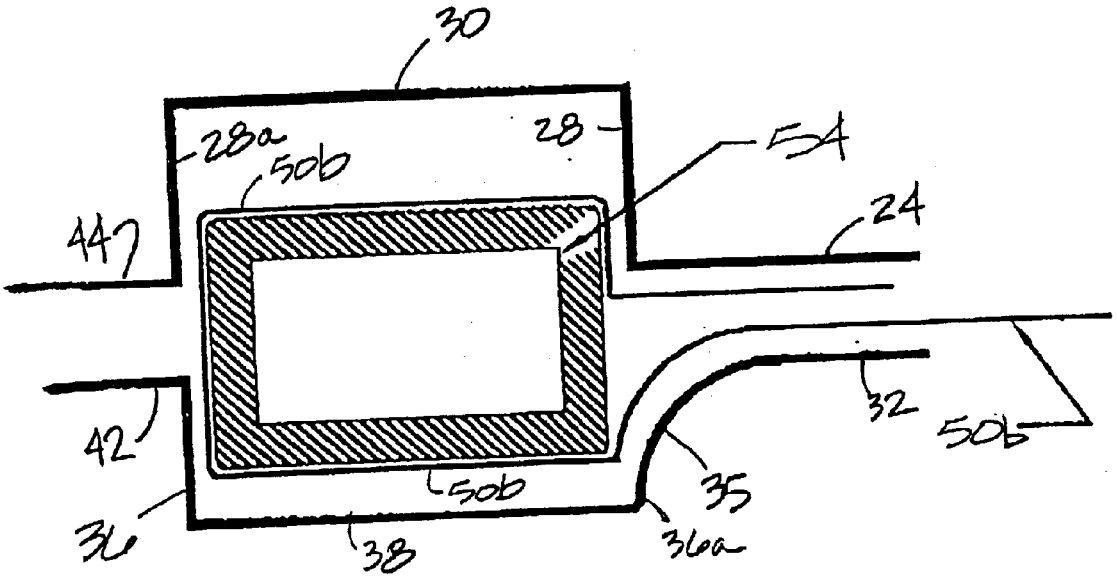
FIG. 5*a* is a detailed view of an embodiment of the present invention, wherein a geosynthetic reinforcement is not engaged by a locking bar.
Figure 5B:
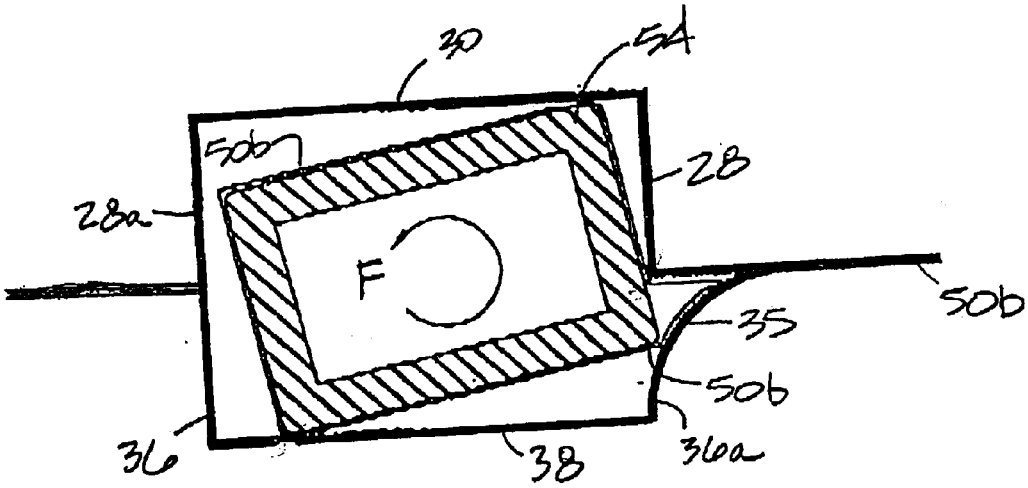
FIG. 5*b* is a detailed view of an embodiment of the present invention, wherein a geosynthetic reinforcement is engaged by a locking bar.

The multifaceted locking bar 54 comprises an elongated member formed of polyvinyl chloride (PVC) or another rigid polymeric material with high tensile and compressive strength, such as nylon or fiberglass reinforced polyester. Of course, other rigid materials are considered such as, by way of example and not limitation, forged, molten, wrought or annealed metals. The locking bar 54 is placed over the geosynthetic reinforcement 50 and received into the upper channel 34, as shown in FIG. 5*a*. The relationship between the locking bar 54 and receiving channel 34 is that of a loose fit, that is, the locking bar 54 is not forced into the receiving channel 34 nor is the locking bar 54 rigidly affixed in any manner prior to the application of a force as described below. In the preferred embodiment the locking bar 54 is four-sided and includes four distinct corners. In the preferred embodiment, each corner comprises a filet of a small radius. The presence of the radius reduces the shear stress applied to the geosynthetic at the points where the bar binds the geosynthetic. Nevertheless, a bar with more or less sides and more or less corners is considered useful in connection with the present invention.

Figure 2:
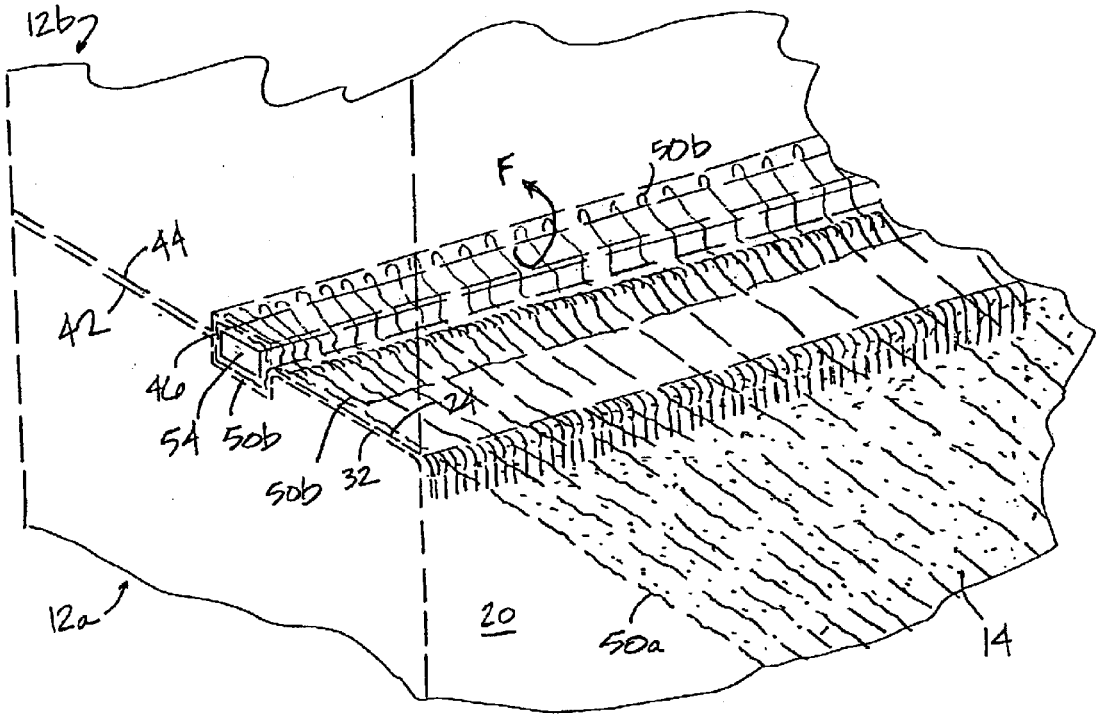
FIG. 2 is a detailed perspective view of an embodiment of the present invention, wherein a geosynthetic reinforcement is looped back over a locking bar.

As illustrated in FIGS. 2 and 5*a*, one portion of the geosynthetic reinforcement 50*b* has been placed over the top surface 32, into the upper channel 34, looped over the locking bar 54, and laid back over itself and upper surface 32. An opposite end of the geosynthetic reinforcement 50*a*, beyond the interior face of the block 20 extends into the adjacent backfill 14 where earth, rocks or other backfill materials are placed to cover the geosynthetic reinforcement 50.

Before backfill 14 is placed on the geosynthetic reinforcement 50, the reinforcement 50 is tensioned to remove slack. As the wall height increases, so do the horizontal stresses at the back of the segmental units 12. The horizontal stresses cause the units 12 to move outward, away from the backfill 14. Because the geosynthetic 50 is in tension and is anchored in place by the overlying soil, outward movement of the block 12 causes the locking bar 54 to rotate. With a small amount of rotation, the bar 54 binds the geosynthetic 50 against at least one adjacent wall of the receiving conduit 46. Once the geosynthetic 50 is bound, stresses behind the segmental unit 12 are transferred to the anchored geosynthetic 50. In this manner, additional segmental unit movement with respect to the adjacent backfill 14 and geosynthetic reinforcement 50 is limited and an efficient connection between the segmental unit 12 and geosynthetic 50 is realized.

Figure 3:
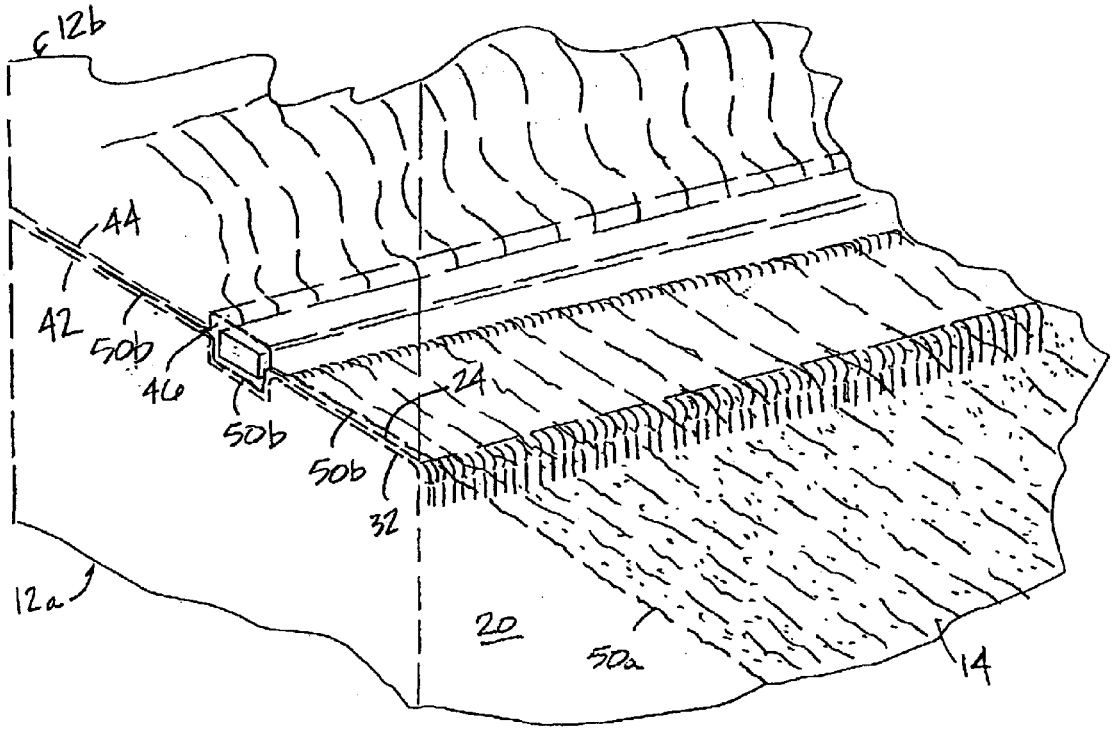
FIG. 3 is a detailed perspective view of an embodiment of the present invention, wherein a geosynthetic reinforcement is not looped back over a locking bar.

As illustrated in FIG. 3, one portion of the geosynthetic reinforcement 50*b* has been placed over the top surface 32 and into the upper channel 34. That section of the geosynthetic reinforcement 50*b* which extends beyond the upper channel 34 is not looped over the locking bar as described above, but is permitted to rest between the top portion 42 and bottom portions 44 of blocks 12*a*, 12*b*, respectively. As described immediately above with reference to FIG. 5*b*, the displacement of the segmental unit 12 with respect to the geosynthetic reinforcement 50 causes the bar 54 to rotate forward F and engage that portion of the geosynthetic reinforcement 50 in contact with the locking bar 54 against at least one interior side of the receiving conduit 46. It is now that the locking bar 54 is rigidly affixed.

A benefit of the edgeless top surface 32 is to prevent a concentration of shear stress on the geosynthetic reinforcement that promotes rupture at a tensile load below the LTDS motion.

As illustrated in FIG. 4, the wall 10 comprises courses of block 12 from which geosynthetic reinforcements 50 extend laterally. Dirt, rocks, or other backfill material 14 is placed to cover the geosynthetic reinforcements 50 and compacted as is well known to those skilled in the art. The wall 10 includes an initial course 60 of base blocks 62. These base block 62 comprise the structural features of the upper half of the block 12 described in detail above. Accordingly, the base blocks 62 include the edgeless top surface 32, upper channel 34, and top portion 42. In this manner, the base blocks 62 nest with the upper course of blocks 12 to form a first receiving conduit 46*a*. Further, the course of base blocks 62 cooperate with adjacent tiers of blocks 12 to extend the first receiving conduit 46*a* the length of the wall 10 for the first geosynthetic reinforcement 50*a*.

Similarly, the upper end of the wall 10 is finished with a top course 70 of cap blocks 72. These cap blocks 72 comprise the structural features of the lower half block 12 described in detail above. Accordingly, the cap block 72 include the bottom surface 24, lower channel 26, and bottom portion 44. In this manner, the cap blocks 72 nest with the upper course of blocks 12 to form a last receiving conduit 46*n*. In the illustrated embodiment, the course 70 of cap blocks 72 define the receiving conduit 46*n* which receives the last geosynthetic reinforcement 50*n*.

The retaining wall 10 of the present invention is constructed in a manner now discussed with reference to FIGS. 1 and 4. The site for the wall 10 is selected and if desired, a channel (not illustrated) is excavated for receiving a footing or first course 60. The initial course 60 of base blocks 62 are placed side-by-side in the excavation, on the footing, or on the ground surface where the wall 10 is to be constructed. A course of blocks 12 is then placed on the base blocks 62. Blocks 12 can be off-set so the sides of the block in the first course are staggered with respect to the sides of the blocks in the adjacent courses.

A geosynthetic reinforcement 50*a* may be connected to the wall 10 within the first receiving conduit 46*a*. Geosynthetic reinforcements 50 are selectively placed to meet the design requirements for the wall 10, and each course does not necessarily require a geosynthetic reinforcement 50. With no geosynthetic reinforcement 50 installed, the next course of blocks 12 is stacked on the lower course. Where a geosynthetic reinforcement 50 is required, a geosynthetic reinforcement 50 and at least one locking bar 54 is placed in the upper channel 34 of the blocks 12. The locking bar 54 is positioned within the channel 34 on top of the geosynthetic reinforcement 50 and lapped or not lapped as described above. Each geosynthetic grid 50 is then captured in the wall 10 by stacking the next course of blocks 12. The upper block 12*b* can be nested with the lower block 12*a* by the mating connection created by the lower top portion 42 and the upper bottom portion 44. When two courses are thus stacked together, the respective channels 34, 26 mate to form a receiving conduit 46.

Backfill material 14 is then placed to cover the laterally extending geosynthetic reinforcements 50.

The foregoing process continues by repeatedly stacking upper courses of blocks 12*b* upon lower courses of blocks 12*a* until the wall 10 is the desired height. At selected courses, the geosynthetic reinforcements 50 and locking bar 54 are captured by the receiving conduits 46, as discussed above. Finally, the cap blocks 72 are installed to finish the wall 10. The improved retaining capacity of the present invention does not require installing a geosynthetic reinforcement 50 and locking bar 54 between each courses of block or along the entire length of the wall 10.

In an alternative embodiment not illustrated, the blocks may be oversized. These oversized blocks are elongated and include the structural and functional features described above with respect to blocks 12. An upper channel 34 receives the locking bar 54 as described above. The geosynthetic reinforcement 50 is attached to the locking bars 54 as described above. The lower channel 26 of the next course captures the geosynthetic reinforcement 50 and locking bar 54 in the receiving conduit 46 as described above. Dirt or other backfill 14 then covers the geosynthetic reinforcement 50 extending laterally from the wall 10.

In an alternative embodiment (not shown), the channel 34 and the channel 26 may be vertically orientated on opposite sides of the blocks 12. In a manner similar to that described above, the geosynthetic reinforcements 50 are then inserted in vertical receiving channels and a locking bar 54 is inserted. Thereafter, an adjacent block 12 placed to form a vertical receiving conduit. As described above, the geosynthetic reinforcement 50 extends vertically into the backfill 14 and may remain vertical within the backfill or rotated and positioned horizontally.

In an alternative embodiment (not shown), the geosynthetic reinforcement 50 may be secured to anchors, such as concrete dead men, buried in the backfill 14. The geosynthetic reinforcement 50, or the geosynthetic reinforcement 50 and anchor combination, may be placed in any orientation within the backfill 14 which might be sufficient to construct a reinforced wall.

Thus, it is shown that an improved retaining wall is now provided which is constructed of hand-stackable modules; which is constructed from a minimum number of readily available components; which includes a connector that utilizes the long-term design strength of the geosynthetic reinforcement; which evenly distributing the load of the backfill across the width of the wall; which eliminates concentrated stresses within the components; which does not require the anchor and wall connection be tightly fitted and locked during assembly, and which provides components which do not pose a threat of rupture to the geosynthetic reinforcement.

While this invention has been described in detail with reference to a geosynthetic-reinforced earth retaining wall embodiment, it will be understood that the components and method discussed above may be used for other applications described immediately below, for the purpose of illustration—not limitation, and claimed further below.

For example, it is considered that the components described above and claimed below may be used to construct an exterior finish of a structure. Here, the block 12 may be attached to a geosynthetic reinforcement 50 that is, in turn, secured to a frame or superstructure.

Again, it is considered that the components described above and claimed below may be used to construct a free-standing double width wall. Here, double walls 10 of block 12 are stacked adjacent to each other with geosynthetic reinforcements 50 positioned within the receiving conduit of the first wall at one end and within the receiving conduit of the second wall at an opposite end, rather than backfill 14.

Further, it is considered that the components described above and claimed below may be used to construct the weight bearing foundation wall of a structure, a sea-wall, various kinds of pools, dykes, levees; essentially any application as may be required by a civil engineer or one similarly skilled in the arts.

What is claimed is:

1. A rotatable locking bar in contact with a geosynthetic reinforcement and between a plurality of segmental units, wherein each of said segmental units, when stacked on another segmental unit, forms a receiving conduit which loosely captures said locking bar and said geosynthetic reinforcement, said locking bar comprising:

a corner for engaging and holding at least one of said segmental units to said geosynthetic reinforcement; and the locking bar being sized relative to the size of the receiving conduit so as to fit within the receiving conduit with sufficient looseness to rotate within the receiving conduit whereby the corner of the locking bar engages the geosynthetic reinforcement within at least one side of the receiving channel, in response to a load applied to the stacked segmental units relative to the geosynthetic reinforcement, thereby transferring the load to the geosynthetic reinforcement.

2. The apparatus of claim 1, wherein said geosynthetic reinforcement is captured within said receiving conduit between a lower segmental unit, said locking bar, and an upper segmental unit.

3. The apparatus of claim 1, wherein a distal end of said geosynthetic reinforcement extends from said locking bar and is loaded with a force.

4. The apparatus of claim 3, wherein said force displaces said segmental units and geosynthetic reinforcement away from each other.

5. The apparatus of claim 4, wherein said displaced segmental units and geosynthetic reinforcement rotates said locking bar until said corner engages and holds said geosynthetic reinforcement to an interior surface of said receiving conduit.

6. A retaining wall, comprising;

a plurality of segmental units, each including an upper channel, an edgeless portion and a lower channel, positioned to form a lower course;

a plurality of segmental units, each including an upper channel, an edgeless portion and a lower channel, stacked on said lower course to form an upper course;

a receiving conduit formed by the stacking of said lower and upper courses and the mating of said lower and upper channels;

a rotatable locking bar loosely positioned within said receiving conduit, wherein said rotatable locking bar includes a corner which engages and holds said geosynthetic reinforcement to an interior surface of said receiving conduit;

a geosynthetic reinforcement in contact with said rotatable locking bar at a first end, and a second end of said geosynthetic reinforcement extending laterally to receive a backfill load; and, a plurality of forces, generated by said backfill load, that act to displace said segmental unit and said geosynthetic reinforcement which, in turn, rotates said locking bar such that said locking bar engages and holds said first end to an interior surface of said receiving conduit.

7. The wall of claim 6, wherein said geosynthetic reinforcement is positioned over said edgeless portion and within said upper channel, followed by said locking bar, such that said geosynthetic reinforcement is captured within said receiving conduit between said upper channel and said locking bar.

8. The wall of claim 6, wherein said geosynthetic reinforcement is positioned over said edgeless portion and within said upper channel, followed by said locking bar, and then looped back over said locking bar, such that said geosynthetic reinforcement is captured within said receiving conduit between said upper channel, said locking bar, and said lower channel.

9. A retaining wall, comprising;

a plurality of segmental units, each including a channel and an edgeless portion positioned to form a lower course;

a plurality of segmental units, each including a channel and an edgeless portion stacked on said lower course to form an upper course;

a receiving conduit formed by the stacking of said lower and upper courses;

a rotatable locking bar loosely positioned within said receiving conduit, wherein said rotatable locking bar includes a corner that engages and holds said geosynthetic reinforcement to an interior surface of said receiving conduit;

a geosynthetic reinforcement in contact with said rotatable locking bar at a first end, and a second end of said geosynthetic reinforcement extending laterally to receive a backfill load; and, a plurality of forces, generated by said backfill load, that act to displace said segmental unit relative to said geosynthetic reinforcement, in response to which the geosynthetic reinforcement rotates said locking bar within the receiving conduit such that said locking bar engages and holds said first end of said geosynthetic reinforcement to an interior surface of said receiving conduit.

10. The wall of claim 9, wherein said geosynthetic reinforcement is positioned over said edgeless portion and within said receiving channel, followed by said locking bar, such that said geosymthetic reinforcement is captured within said receiving conduit between said upper segmental unit and said locking bar.

11. The wall of claim 9, wherein said geosynthetic reinforcement is positioned over said edgeless portion and within said receiving channel, followed by said locking bar, such that said geosynthetic reinforcement is captured within said receiving conduit between said lower segmental unit and said locking bar.

12. The wall of claim 9, wherein said geosynthetic reinforcement is positioned over said edgeless portion and within said receiving channel, followed by said locking bar, and then looped back over said locking bar, such that said geosynthetic reinforcement is captured within said receiving conduit between said upper segmental unit and said locking bar and between said lower segmental unit and said locking bar.

13. A method of constructing a wall, comprising the steps of:

stacking segmental units which include internal channels;

positioning one end of a geosynthetic reinforcement over one of said internal channels;

inserting over said geosynthetic reinforcement and into said internal channel a locking bar that is narrower than the internal channel, so that the locking bar is rotatable within the internal channel;

capturing said rotatable locking bar and geosynthetic reinforcement within one of said internal channels with another segmental unit;

loading a distal end of said geosynthetic reinforcement with a force sufficient to rotate the locking bar captured with the geosynthetic reinforcement within the internal channels; and holding said geosynthetic reinforcement to a surface of said internal channels in response to said rotation of the locking bar, so that the force on the geosynthetic reinforcement is transferred to the surface of the internal channels.

14. The method of claim 13, wherein said step of loading with a force further comprises pulling said geosynthetic reinforcement in a direction away from said locking bar.

15. A method of constructing a wall, comprising the steps of:

stacking segmental units which include internal channels;

positioning one end of a geosynthetic reinforcement over one of said internal channels;

inserting a rotatable locking bar over said geosynthetic reinforcement and into said internal channel;

capturing said rotatable locking bar and geosynthetic reinforcement within one of said internal channels with another segmental unit;

loading a distal end of said geosynthetic reinforcement with a force by pulling said geosynthetic reinforcement in a direction away from said locking bar to rotate said locking bar;

holding said geosynthetic reinforcement to a surface of said internal channel; and wherein said step of pulling further comprises rotating said rotatable locking bar.

16. The method of claim 15, wherein said step of rotating further comprises engaging said geosynthetic reinforcement with a corner of said locking bar.

17. A method of constructing a wall, comprising the steps of:

stacking segmental units which include internal conduits;

positioning one end of a geosynthetic reinforcement over one of said internal conduits;

inserting over said geosynthetic reinforcement and into said internal conduit a locking bar that is rotatable within the internal conduit;

capturing said rotatable locking bar and geosynthetic reinforcement within said internal conduit by with another segmental unit; and loading a distal end of said geosynthetic reinforcement with a force that causes the locking bar to rotate within the internal conduit;

whereby the rotation of the locking bar within the internal conduit transfers the force on the geosynthetic reinforcement to a surface of said internal conduit.

18. The method of claim 17, wherein said step of inserting further comprises placing said rotatable locking bar within an internal conduit which is wider than said locking bar.

19. The method of claim 17, wherein said step of loading with a force further comprises pulling said geosynthetic reinforcement in a direction away from said locking bar.

20. A method of constructing a wall, comprising the steps of:

stacking segmental units which include internal conduits;

positioning one end of a geosynthetic reinforcement over one of said internal conduits;

inserting a rotatable locking bar over said geosynthetic reinforcement and into said internal conduit;

capturing said rotatable locking bar and geosynthetic reinforcement within said internal conduit by with another segmental unit;

loading a distal end of said geosynthetic reinforcement with a force that pulls said geosynthetic reinforcement in a direction away from said locking bar;

holding said geosynthetic reinforcement to a surface of said internal conduit; and said step of pulling further comprises rotating said rotatable locking bar.

21. The method of claim 20, wherein said step of rotating further comprises engaging said geosynthetic reinforcement with a corner of said locking bar.

* * * * *